US009677557B2

(12) United States Patent
Hsu

(10) Patent No.: US 9,677,557 B2
(45) Date of Patent: Jun. 13, 2017

(54) SLEEPING SYSTEM

(71) Applicant: Hao Hsu, Wan Chai (HK)

(72) Inventor: Hao Hsu, Wan Chai (HK)

( * ) Notice: Subject to any disclaimer, the term of this patent is extended or adjusted under 35 U.S.C. 154(b) by 227 days.

(21) Appl. No.: 14/600,811

(22) Filed: Jan. 20, 2015

(65) Prior Publication Data

US 2016/0208795 A1 Jul. 21, 2016

(51) Int. Cl.

| | |
|---|---|
| ***F04B 53/00*** | (2006.01) |
| ***F04B 43/02*** | (2006.01) |
| ***F04B 45/04*** | (2006.01) |
| ***F04B 39/00*** | (2006.01) |
| *F04B 45/047* | (2006.01) |
| *F04B 43/04* | (2006.01) |

(52) U.S. Cl.

CPC ..... *F04B 53/001* (2013.01); *F04B 39/005* (2013.01); *F04B 43/02* (2013.01); *F04B 45/04* (2013.01); *F04B 43/04* (2013.01); *F04B 45/047* (2013.01); *F04B 2201/0804* (2013.01)

(58) Field of Classification Search

CPC ..... F04B 45/04; F04B 45/047; F04B 43/04; F04B 45/00; F04B 39/0027; F04B 53/001; F04B 39/005; F04B 45/041; F04B 45/043; F04B 45/045

USPC ..... 417/413.1, 312, 540; 181/258, 222, 252, 181/256, 288, 294

See application file for complete search history.

(56) References Cited

U.S. PATENT DOCUMENTS 3,341,115 A * 9/1967 Beck ..... F04B 45/045 417/312
3,367,561 A * 2/1968 Beck ..... F04B 39/102 417/413.1
3,830,596 A * 8/1974 Kondo ..... A01K 63/042 210/167.26
3,838,944 A * 10/1974 Kolfertz ..... F04B 11/0008 417/312
3,877,842 A * 4/1975 Greene ..... F04B 39/0061 417/312
4,258,821 A * 3/1981 Wendt ..... F04D 29/664 181/202
4,316,523 A * 2/1982 Boretti ..... B25D 17/12 181/226
4,829,616 A * 5/1989 Walker ..... A47C 27/082 200/83 Q
4,877,378 A * 10/1989 Saggers ..... F04B 45/047 417/299
4,938,309 A * 7/1990 Emdy ..... F01N 13/002 15/314

(Continued)

*Primary Examiner* — Alexander Comley
(74) *Attorney, Agent, or Firm* — Muncy, Geissler, Olds & Lowe, P.C.

(57) ABSTRACT

A sleeping system is provided, including an air bladder and a diaphragm pump. The diaphragm pump communicates with the air bladder. The diaphragm pump includes a base, a first inlet, a first outlet, a first noise-eliminating foam, a pump body and a cover. The first inlet is formed on the base. The first outlet is formed on the base. The first noise-eliminating foam is disposed in the base. The cover is connected to the base and covers the pump body, wherein air flow passes through the first inlet into the base and travels through the pump body and the first noise-eliminating foam, and leaves the diaphragm pump through the first outlet to be infused into the air bladder.

14 Claims, 2 Drawing Sheets

(56) References Cited

U.S. PATENT DOCUMENTS

| | | | | | |
|---|---|---|---|---|---|
| 4,993,925 | A * | 2/1991 | Becker | F04B 43/0009 | 417/413.1 |
| 5,017,100 | A * | 5/1991 | Arkans | F04B 43/04 | 137/903 |
| 5,097,924 | A * | 3/1992 | Reeves | F01N 1/082 | 181/230 |
| 5,232,353 | A * | 8/1993 | Grant | F04B 7/0038 | 417/413.1 |
| 5,588,811 | A * | 12/1996 | Price | A47C 20/048 | 417/350 |
| 5,810,566 | A * | 9/1998 | Pauwels | F01N 1/24 | 181/252 |
| 6,007,307 | A * | 12/1999 | Sonoda | F04B 45/047 | 417/312 |
| 6,037,723 | A * | 3/2000 | Shafer | A47C 27/082 | 318/6 |
| 6,109,387 | A * | 8/2000 | Boretti | F01N 1/082 | 181/217 |
| 6,206,654 | B1 * | 3/2001 | Cassidy | A47C 27/082 | 417/312 |
| 6,702,880 | B2 * | 3/2004 | Roberts | B01D 46/0023 | 181/231 |
| 6,810,989 | B1 * | 11/2004 | Dantlgraber | H02K 5/24 | 123/195 R |
| 7,198,076 | B2 * | 4/2007 | Wu | F04D 27/00 | 141/10 |
| 2004/0055815 | A1 * | 3/2004 | Sterling | B23B 47/00 | 181/230 |
| 2005/0112004 | A1 * | 5/2005 | Becker | F04B 39/128 | 417/440 |
| 2013/0058802 | A1 * | 3/2013 | Roman | F04B 45/043 | 417/312 |

* cited by examiner

SLEEPING SYSTEM

BACKGROUND OF THE INVENTION

Field of the Invention

The present invention relates to a diaphragm pump, and in particular to a diaphragm pump utilized in a sleeping system.

Description of the Related Art

A diaphragm pump is commonly utilized in a sleeping system (for example, a bed) to inflate the sleeping system. However, the diaphragm pump generates a great amount of noise. When the diaphragm pump inflates the sleeping system at night, the noise might bother people sleeping nearby.

BRIEF SUMMARY OF THE INVENTION

In one embodiment of the invention, a sleeping system is provided, comprising an air bladder and a diaphragm pump. The diaphragm pump communicates with the air bladder. The diaphragm pump comprises a base, a first inlet, a first outlet, a first noise-eliminating foam, a pump body and a cover. The first inlet is formed on the base. The first outlet is formed on the base. The first noise-eliminating foam is disposed in the base. The cover is connected to the base and covers the pump body, wherein air flow passes through the first inlet into the base and travels through the pump body and the first noise-eliminating foam, and then leaves the diaphragm pump through the first outlet to be infused into the air bladder.

In one embodiment of the sleeping system, the first inlet is formed on a lateral side of the base.

In one embodiment of the sleeping system, the diaphragm pump further comprises a second noise-eliminating foam, and the second noise-eliminating foam corresponds to the first inlet.

In one embodiment of the sleeping system, the base comprises an inner enclosure protruding from a bottom surface of the base, and the first noise-eliminating foam is enclosed by the inner enclosure.

In one embodiment of the sleeping system, the diaphragm pump further comprises a fixing sheet, and the first noise-eliminating foam is received in a chamber formed by the bottom surface of the base, the inner enclosure and the fixing sheet.

In one embodiment of the sleeping system, the pump body comprises a second inlet and a second outlet, and the air flow enters the pump body through the second inlet, and leaves the pump body through the second outlet.

In one embodiment of the sleeping system, the diaphragm pump further comprises an O-ring, and the O-ring is telescoped on the second outlet.

In one embodiment of the sleeping system, a first opening is formed on the fixing sheet, the O-ring is disposed in the first opening, and the second outlet passes through the first opening.

In one embodiment of the sleeping system, the first opening corresponds to the first noise-eliminating foam, and the air flow emitted from the second outlet passes through the first noise-eliminating foam to reduce noise.

In one embodiment of the sleeping system, a second opening is formed on the inner enclosure, the second opening corresponds to the first outlet, and the air flow travels from the first noise-eliminating foam, passing through the second opening and the first outlet, to be infused into the air bladder.

In one embodiment of the sleeping system, the air flow enters the first noise-eliminating foam in a first direction, and leaves the first noise-eliminating foam in a second direction. The first direction is perpendicular to the second direction.

In one embodiment of the invention, a diaphragm pump for inflating an air bladder of a sleeping system is provided. The diaphragm pump comprises a base, a first inlet, a first outlet, a first noise-eliminating foam, a pump body and a cover. The first inlet is formed on the base. The first outlet is formed on the base. The first noise-eliminating foam is disposed in the base. The cover is connected to the base and covers the pump body, wherein air flow passes through the first inlet into the base and travels through the pump body and the first noise-eliminating foam, and then leaves the diaphragm pump through the first outlet to be infused into the air bladder.

In one embodiment of the diaphragm pump, the first inlet is formed on a lateral side of the base.

In one embodiment of the diaphragm pump, the diaphragm pump further comprises a second noise-eliminating foam, and the second noise-eliminating foam corresponds to the first inlet.

In one embodiment of the diaphragm pump, the base comprises an inner enclosure protruding from a bottom surface of the base, and the first noise-eliminating foam is enclosed by the inner enclosure.

In one embodiment of the diaphragm pump, the diaphragm pump further comprises a fixing sheet, and the first noise-eliminating foam is received in a chamber formed by the bottom surface of the base, the inner enclosure and the fixing sheet.

In one embodiment of the diaphragm pump, the pump body comprises a second inlet and a second outlet, and the air flow enters the pump body through the second inlet, and leaves the pump body through the second outlet.

In one embodiment of the diaphragm pump, the diaphragm pump further comprises an O-ring, and the O-ring is telescoped on the second outlet.

In one embodiment of the diaphragm pump, a first opening is formed on the fixing sheet, the O-ring is disposed in the first opening, and the second outlet passes through the first opening.

In one embodiment of the diaphragm pump, the first opening corresponds to the first noise-eliminating foam, and the air flow emitted from the second outlet passes through the first noise-eliminating foam to reduce noise.

In one embodiment of the diaphragm pump, a second opening is formed on the inner enclosure, the second opening corresponds to the first outlet, and the air flow travels from the first noise-eliminating foam, passing through the second opening and the first outlet to be infused into the air bladder.

In one embodiment of the diaphragm pump, the air flow enters the first noise-eliminating foam in a first direction, the air flow leaves the first noise-eliminating foam in a second direction, and the first direction is perpendicular to the second direction.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
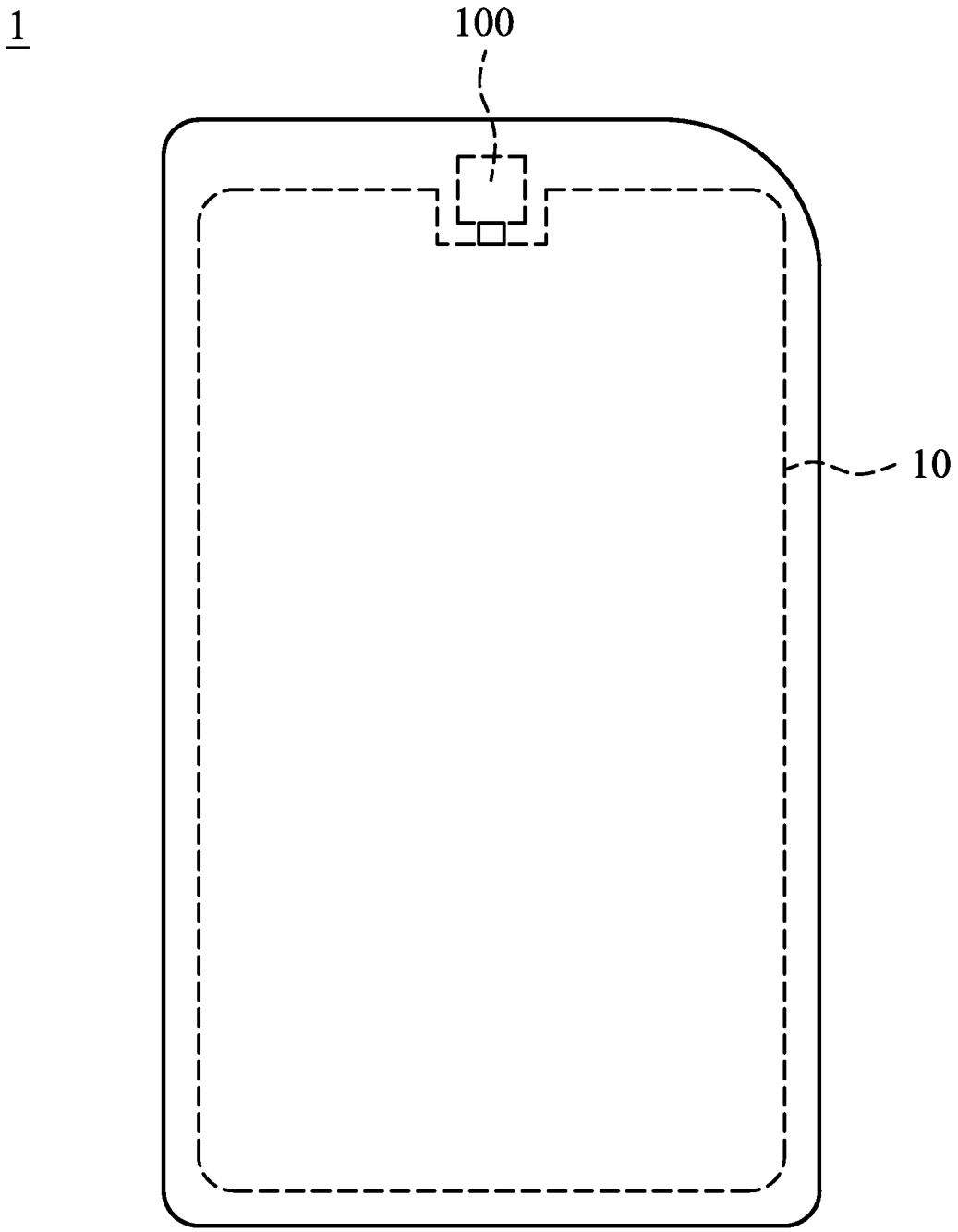
FIG. 1 shows a sleeping system of an embodiment of the invention.

FIG. 1 shows a sleeping system 1 of an embodiment of the invention, comprising an air bladder 10 and a diaphragm pump 100. The diaphragm pump 100 communicates with the air bladder 10.

Figure 2:
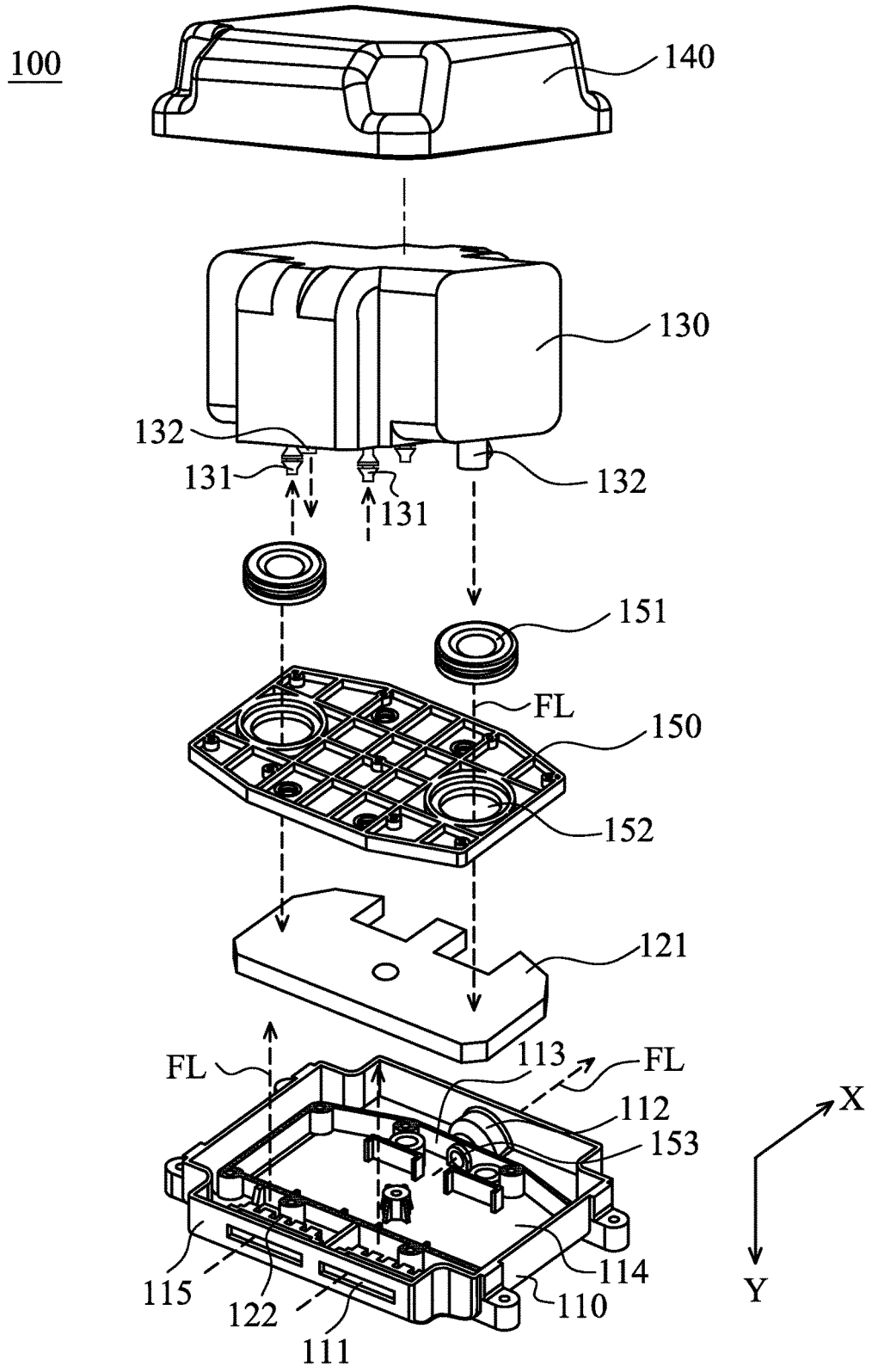
FIG. 2 shows a diaphragm pump of an embodiment of the invention.

FIG. 2 shows the diaphragm pump 100 of an embodiment of the invention, comprising a base 110, first inlets 111 (not shown), a first outlet 112, a first noise-eliminating foam 121, a pump body 130 and a cover 140. The first inlet 111 is formed on the base 110. The first outlet 112 is formed on the base 110. The first noise-eliminating foam 121 is disposed in the base 110. The cover 140 is connected to the base 110 and covers the pump body 130, wherein air flow FL passes through the first inlets 111 (not shown) into the base 110 and travels through the pump body 130 and the first noise-eliminating foam 121, and then leaves the diaphragm pump 100 through the first outlet 112 to be infused into the air bladder 10.

In one embodiment, the first noise-eliminating foam 121 has compact inner structure, and the pump body 130 provides high air pressure to urge air flow passing through the first noise-eliminating foam 121 and to reduce noise. In one embodiment, the air pressure provided by the pump body 130 is greater than 1 atm.

The first inlets 111 are formed on a lateral side 115 of the base 110. The diaphragm pump 100 further comprises second noise-eliminating foams 122, and the second noise-eliminating foams 122 respectively correspond to the first inlet 111.

The base 110 comprises an inner enclosure 113 protruding from a bottom surface 114 of the base 110. The first noise-eliminating foam 121 is enclosed by the inner enclosure 113.

The diaphragm pump 100 further comprises a fixing sheet 150, and the first noise-eliminating foam 121 is received in a chamber formed by the bottom surface 114 of the base 110, the inner enclosure 113 and the fixing sheet 150.

The pump body 130 comprises second inlets 131 and second outlets 132, and the air flow enters the pump body 130 through the second inlets 131, and leaves the pump body 130 through the second outlets 132.

The diaphragm pump 100 further comprises O-rings 151, and the O-rings 151 are respectively telescoped on the second outlet 132.

First openings 152 are formed on the fixing sheet 150, the O-rings 151 are respectively disposed in the first opening 152, and the second outlets 132 respectively pass through the first openings 152.

The first openings 152 are corresponding to the first noise-eliminating foam 121, and the air flow FL emitted from the second outlets 132 passing through the first noise-eliminating foam 121 to reduce noise.

A second opening 153 is formed on the inner enclosure 113, the second opening 153 corresponds to the first outlet 112, and the air flow FL travels from the first noise-eliminating foam 121, passing through the second opening 153 and the first outlet 112 to be infused into the air bladder.

The air flow FL enters the first noise-eliminating foam 121 in a first direction Y, the air flow FL leaves the first noise-eliminating foam 121 in a second direction X, and the first direction Y is perpendicular to the second direction X.

In one embodiment, a flow rate of the diaphragm pump is about 22 L/min.

Conventionally, the foam made with compact inner structure cannot be utilized as a noise-eliminating foam in a diaphragm pump for a sleeping system. However, in the sleeping system of the embodiment of the invention, with the high air pressure and the high air flow rate provided by the pump body and the properly designed flow path, the first noise-eliminating foam 121 with compact inner structure can be utilized to reduce noise, the noise generated by the diaphragm pump is decreased, and the diaphragm pump still provides sufficient air pressure and air flow rate. In one embodiment, the noise generated by the diaphragm pump can be reduced from 40~45 dB to 30~35 dB.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A sleeping system, comprising:

an air bladder; and a diaphragm pump, communicated to the air bladder, comprising:

a base;

a first inlet, formed on the base;

a first outlet, formed on the base;

a first noise-eliminating foam, disposed in the base;

a pump body; and a cover, connected to the base and covering the pump body, wherein an air flow passes through the first inlet into the base and travels through the pump body and the first noise-eliminating foam, and then leaves the diaphragm pump through the first outlet to be infused into the air bladder, wherein the base comprises an inner enclosure protruding from a bottom surface of the base, and the first noise-eliminating foam is enclosed by the inner enclosure, wherein the diaphragm pump further comprises a fixing sheet, and the first noise-eliminating foam is received in a chamber formed by the bottom surface of the base, the inner enclosure and the fixing sheet, wherein the pump body comprises a second inlet and a second outlet, and the air flow enters the pump body through the second inlet, and leaves the pump body through the second outlet, and wherein the diaphragm pump further comprises an O-ring, and the O-ring is telescoped on the second outlet.

2. The sleeping system as claimed in claim 1, wherein the first inlet is formed on a lateral side of the base.

3. The sleeping system as claimed in claim 2, wherein the diaphragm pump further comprises a second noise-eliminating foam, and the second noise-eliminating foam corresponds to the first inlet.

4. The sleeping system as claimed in claim 1, wherein a first opening is formed on the fixing sheet, the O-ring is disposed in the first opening, and the second outlet passes through the first opening.

5. The sleeping system as claimed in claim 4, wherein the first opening corresponds to the first noise-eliminating foam, and the air flow emitted from the second outlet passes through the first noise-eliminating foam to reduce noise.

6. The sleeping system as claimed in claim 5, wherein a second opening is formed on the inner enclosure, the second opening corresponds to the first outlet, and the air flow travels from the first noise-eliminating foam, passing through the second opening and the first outlet to be infused into the air bladder.

7. The sleeping system as claimed in claim 6, wherein the air flow enters the first noise-eliminating foam in a first direction, the air flow leaves the first noise-eliminating foam in a second direction, and the first direction is perpendicular to the second direction.

8. A diaphragm pump for inflating an air bladder of a sleeping system, comprising:

a base;

a first inlet, formed on the base;

a first outlet, formed on the base;

a first noise-eliminating foam, disposed in the base;

a pump body;

a cover, connected to the base and covering the pump body, wherein an air flow passes through the first inlet into the base and travels through the pump body and the first noise-eliminating foam, and leaves the diaphragm pump through the first outlet to be infused into the air bladder, wherein the base comprises an inner enclosure protruding from a bottom surface of the base, and the first noise-eliminating foam is enclosed by the inner enclosure;

a fixing sheet, wherein the first noise-eliminating foam is received in a chamber formed by the bottom surface of the base, the inner enclosure and the fixing sheet, wherein the pump body comprises a second inlet and a second outlet, and the air flow enters the pump body through the second inlet, and leaves the pump body through the second outlet; and an O-ring, wherein the O-ring is telescoped on the second outlet.

9. The diaphragm pump as claimed in claim 8, wherein the first inlet is formed on a lateral side of the base.

10. The diaphragm pump as claimed in claim 9, further comprising a second noise-eliminating foam, wherein the second noise-eliminating foam corresponds to the first inlet.

11. The diaphragm pump as claimed in claim 8, wherein a first opening is formed on the fixing sheet, the O-ring is disposed in the first opening, and the second outlet passes through the first opening.

12. The diaphragm pump as claimed in claim 11, wherein the first opening corresponds to the first noise-eliminating foam, and the air flow emitted from the second outlet passes through the first noise-eliminating foam to reduce noise.

13. The diaphragm pump as claimed in claim 12, wherein a second opening is formed on the inner enclosure, the second opening corresponds to the first outlet, and the air flow travels from the first noise-eliminating foam, passing through the second opening and the first outlet to be infused into the air bladder.

14. The diaphragm pump as claimed in claim 13, wherein the air flow enters the first noise-eliminating foam in a first direction, the air flow leaves the first noise-eliminating foam in a second direction, and the first direction is perpendicular to the second direction.

* * * * *